US008305208B2

(12) United States Patent
Judd

(10) Patent No.: US 8,305,208 B2
(45) **Date of Patent: *Nov. 6, 2012**

(54) AIRCRAFT UPLINK MESSAGE RESPONSE PROMPT

(75) Inventor: Thomas D. Judd, Woodinville, WA (US)

(73) Assignee: Honeywell International Inc., Morristown, NJ (US)

( * ) Notice: Subject to any disclaimer, the term of this patent is extended or adjusted under 35 U.S.C. 154(b) by 545 days.

This patent is subject to a terminal disclaimer.

(21) Appl. No.: 12/434,763

(22) Filed: May 4, 2009

(65) Prior Publication Data

US 2010/0277347 A1 Nov. 4, 2010

(51) Int. Cl.
*G08B 26/00* (2006.01)

(52) U.S. Cl. ..... 340/505; 340/539.1; 340/539.13; 340/3.1; 340/6.1

(58) Field of Classification Search ..... 340/505, 340/539.1, 539.13, 3.1, 6.1
See application file for complete search history.

(56) References Cited

U.S. PATENT DOCUMENTS

| | | | | |
|---|---|---|---|---|
| 5,003,619 | A | 3/1991 | Morris et al. | |
| 6,085,145 | A | 7/2000 | Taka et al. | |
| 6,175,314 | B1 | 1/2001 | Cobley | |
| 6,181,260 | B1 | 1/2001 | Simon et al. | |
| 6,195,609 | B1 | 2/2001 | Pilley et al. | |
| 6,282,417 | B1 | 8/2001 | Ward | |
| 6,313,759 | B1 | 11/2001 | Musland-Sipper | |
| 6,608,559 | B1 * | 8/2003 | Lemelson et al. | 340/539.13 |
| 2003/0006910 | A1 | 1/2003 | Dame | |
| 2003/0153263 | A1 | 8/2003 | Glass | |
| 2004/0124998 | A1 | 7/2004 | Dame | |
| 2004/0132452 | A1 | 7/2004 | Lee | |
| 2008/0114504 | A1 | 5/2008 | Goodman et al. | |
| 2008/0154486 | A1 | 6/2008 | Coulmeau | |
| 2008/0163093 | A1 | 7/2008 | Lorido | |
| 2008/0316057 | A1 | 12/2008 | McGuffin | |

(Continued)

FOREIGN PATENT DOCUMENTS

| | | |
|---|---|---|
| EP | 2012493 | 1/2009 |

(Continued)

OTHER PUBLICATIONS

Eurocontrol , "Cascade Applications—Information Paper", Nov. 3, 2004, pp. 1-15, Publisher: Aeronautical Communications Panel (ACP)—Working Group N (Networking), Published in: New Orleans, US.

(Continued)

*Primary Examiner* — Daryl Pope
(74) *Attorney, Agent, or Firm* — Fogg & Powers LLC

(57) ABSTRACT

A method for prompting an operator to reply to a first data link message before it expires includes receiving the first data link message, storing the first data link message, starting a timer at an initial timer value when the first data link message is received, determining whether a response to the first data link message has been input, determining whether the timer will expire in less than a predefined amount of time, requesting an input from the operator before the timer expires, determining whether the input has been received since requesting input, and determining whether the timer has expired before the input is received. In cases where the input is received before the timer expires, a second data link message is sent. In cases where the input is not received before the timer expires, a status for the first data link message is set to expired.

20 Claims, 9 Drawing Sheets

U.S. PATENT DOCUMENTS

| | | | |
|---|---|---|---|
| 2010/0188266 | A1 | 7/2010 | Judd et al. |
| 2010/0277292 | A1 | 11/2010 | McGuffin et al. |

FOREIGN PATENT DOCUMENTS

| | | |
|---|---|---|
| WO | 2006087276 | 8/2006 |
| WO | 2007064734 | 6/2007 |

OTHER PUBLICATIONS

Asbury, M.J.A., "Integration of ADS and CPDLC in the NAT Region—Integrated Scenarios", "Aeronautical Telecommunications Network Panel, Working Group 3 Meeting", Mar. 4, 1997, pp. 1-23, Published in: Phuket, Thailand.

European Patent Office, "Office Action", Jul. 22, 2010, Published in: EP.

European Patent Office, "European Search Report", mailed Jul. 8, 2010 , Published in: EP.

"Interoperability Requirements Standard for Aeronautical Telecommunication Network Baseline 1 (ATN B1 Interop Standard)", Jun. 26, 2007, pp. 101-107, vol. 1, Publisher: RTCA, Incorporated, Published in: Washington, DC.

U.S. Patent and Trademark Office, "Advisory Action", "U.S. Appl. No. 11/765,157", Feb. 15, 2011, pp. 1-3.

European Patent Office, "European Search Report" of foreign counterpart of U.S. Appl. No. 12/686,708, mailed Apr. 6, 2011, pp. 1-3, Published in: EP.

U.S. Patent and Trademark Office, "Final Office Action", "U.S. Appl. No. 11/765,157", Nov. 29, 2010, pp. 1-18.

U.S. Patent and Trademark Office, "Office Action", "U.S. Appl. No. 11/765,157", May 19, 2010, pp. 1-25.

U.S. Patent and Trademark Office, "Office Action", "U.S. Appl. No. 11/765,157", Nov. 25, 2011, pp. 1-17.

U.S. Patent and Trademark Office, "Office Action", "U.S. Appl. No. 12/686,708", May 24, 2012, pp. 1-34.

European Patent Office, "Office Action" of foreign counterpart of U.S. Appl. No. 11/765,157, Apr. 29, 2009, pp. 1-3, Published in: EP.

European Patent Office, "Office Action" of foreign counterpart of U.S. Appl. No. 12/686,708, Apr. 13, 2011, pp. 1-7, Published in: EP.

U.S. Patent and Trademark Office, "Final Office Action", "U.S. Appl. No. 11/765,157", Jul. 6, 2012, pp. 1-21.

European Patent Office, "European Search Report" of foreign counterpart of U.S. Appl. No. 11/765,157, mailed Feb. 19, 2009, pp. 1-5, Published in: EP.

European Patent Office, "Communication under Rule 71(3) EPC" from foreign counterpart of U.S. Appl. No. 12/358,918, Mar. 14, 2011, pp. 1-21.

U.S. Patent and Trademark Office, "Office Action", U.S. Appl. No. 12/358,918, Sep. 26, 2011, pp. 1-15.

U.S. Patent and Trademark Office, "Office Action", U.S. Appl. No. 12/358,918, Apr. 27, 2012, pp. 1-8.

European Patent Office, "European Search Report" of foreign counterpart of U.S. Appl. No. 12/358,918, mailed May 25, 2010, pp. 1-3, Published in: EP.

European Patent Office, "Communication under Rule 71(3) EPC" from foreign counterpart of U.S. Appl. No. 11/765,157, Jan. 8, 2010, pp. 1-19.

European Patent Office, "Communication under Rule 71(3) EPC" from foreign counterpart of U.S. Appl. No. 12/686,708, Jul. 19, 2012, pp. 1-26.

* cited by examiner

AIRCRAFT UPLINK MESSAGE RESPONSE PROMPT

CROSS REFERENCE TO RELATED APPLICATION

This application is related to U.S. patent application Ser. No. 12/358,918 having a title of "METHOD OF FORMULATING RESPONSE TO EXPIRED TIMER FOR DATA LINK MESSAGE" (also referred to herein as "the '918 Application") filed on Jan. 23, 2009. The '918 application is hereby incorporated herein by reference.

BACKGROUND

Air traffic control ("ATC") centers are used at airports to coordinate aircraft traffic around the airport. Pilots and/or flight crew are able to communicate with air traffic controllers stationed at air traffic control centers in a number of ways, including orally via two way radio communication and textually via data link applications hosted by avionics computers. An example data link application is a Controller Pilot Data Link Communications application. Though this disclosure focuses on pilot and/or flight crew interactions with air traffic controllers via the Controller Pilot Data Link Communications application, it also applies to air traffic controllers stationed at an air traffic control center and operators of other vehicles and control centers. In current Controller Pilot Data Link Communications applications, textual messages are exchanged between pilots and/or flight crew onboard an aircraft and air traffic controllers stationed at an air traffic control center through a data link established between the aircraft and the air traffic control center. The data link is typically established via two way communication between wireless radio transceivers.

The data link facilitates two-way traffic between the pilots and/or flight crew onboard the aircraft and the air traffic controllers stationed at air traffic control centers, including uplink messages and downlink messages. Uplink messages are messages received by pilots and/or flight crew onboard aircraft from air traffic controllers stationed at air traffic control centers. Downlink messages are messages sent from pilots and/or flight crew onboard aircraft to air traffic controllers stationed at air traffic control centers. Both uplink messages and downlink messages can be questions, answers, statements, commands, etc. Downlink messages are sometimes predefined messages, to which the pilots and/or flight crew add data values. A dialogue is a series of interconnected uplink and downlink messages. For example, a simple dialogue includes a question received at the aircraft in an uplink message and a response sent from the aircraft in a downlink message. When uplink messages are received at the aircraft, they are typically displayed to the pilot and/or flight crew and stored in a message log. Typically, the uplink messages can be responded to by pilot and/or flight crew by pressing one of several buttons indicating predefined responses such as ACCEPT, REJECT, STANDBY, or REPORT. The message log is typically a database containing all the uplink and downlink messages with associated message details and status information.

To minimize the time uplink messages remain unanswered by a pilot and/or flight crew onboard an aircraft, a termination timer, receiver ("TTR timer") timer is typically setup for uplink messages received at the aircraft. Once a TTR timer expires for a particular uplink message, the message dialogue is closed and the message can no longer be responded to without first finding it in a message log. The message status is changed to EXPIRED in the message log. Sometimes, pilots and/or flight crew input a STANDBY response to messages to reset or add time to the TTR timer.

SUMMARY

A method for prompting an operator to reply to a first data link message before it expires includes receiving the first data link message, storing the first data link message, starting a timer at an initial timer value when the first data link message is received, determining whether a response to the first data link message has been input, determining whether the timer will expire in less than a predefined amount of time, requesting an input from the operator before the timer expires, determining whether the input has been received since requesting input, and determining whether the timer has expired before the input is received. In cases where the input is received before the timer expires, a second data link message is sent. In cases where the input is not received before the timer expires, a status for the first data link message is set to expired.

The details of various embodiments of the claimed invention are set forth in the accompanying drawings and the description below. Other features and advantages will become apparent from the description, the drawings, and the claims.

DRAWINGS

Like reference numbers and designations in the various drawings indicate like elements.

DETAILED DESCRIPTION

In the following detailed description, embodiments are described in sufficient detail to enable those skilled in the art to practice the invention. It is to be understood that other embodiments may be utilized without departing from the scope of the present invention. The following detailed description is, therefore, not to be taken in a limiting sense.

The present invention is directed to a method for prompting an operator to reply to a data link message before it expires. Current Controller Pilot Data Link Communications ("CP-DLC") applications do not inform pilots and/or flight crew when a timer associated with an uplink message will soon expire. It is advantageous for pilots and/or flight crew to receive notifications before uplink messages expire, such that they can respond to the uplink messages without having to go find the messages in the message log. The example systems and methods shown in FIGS. 1-9 and described in this disclosure provide ways of prompting pilots and/or flight crew for a responsive downlink message before the uplink message expires. The same systems and methods can be used for downlink messages received by the air traffic controllers in the control centers and in other data link applications, such as other data link communication between aircraft personnel and other personnel stationed elsewhere or data link communication between sea vessel operators, spacecraft operators, or other vehicle operators and other personnel. In other embodiments, the data link communication could be between different personnel on the same aircraft, vessel, spacecraft, or other vehicle.

Figure 1:
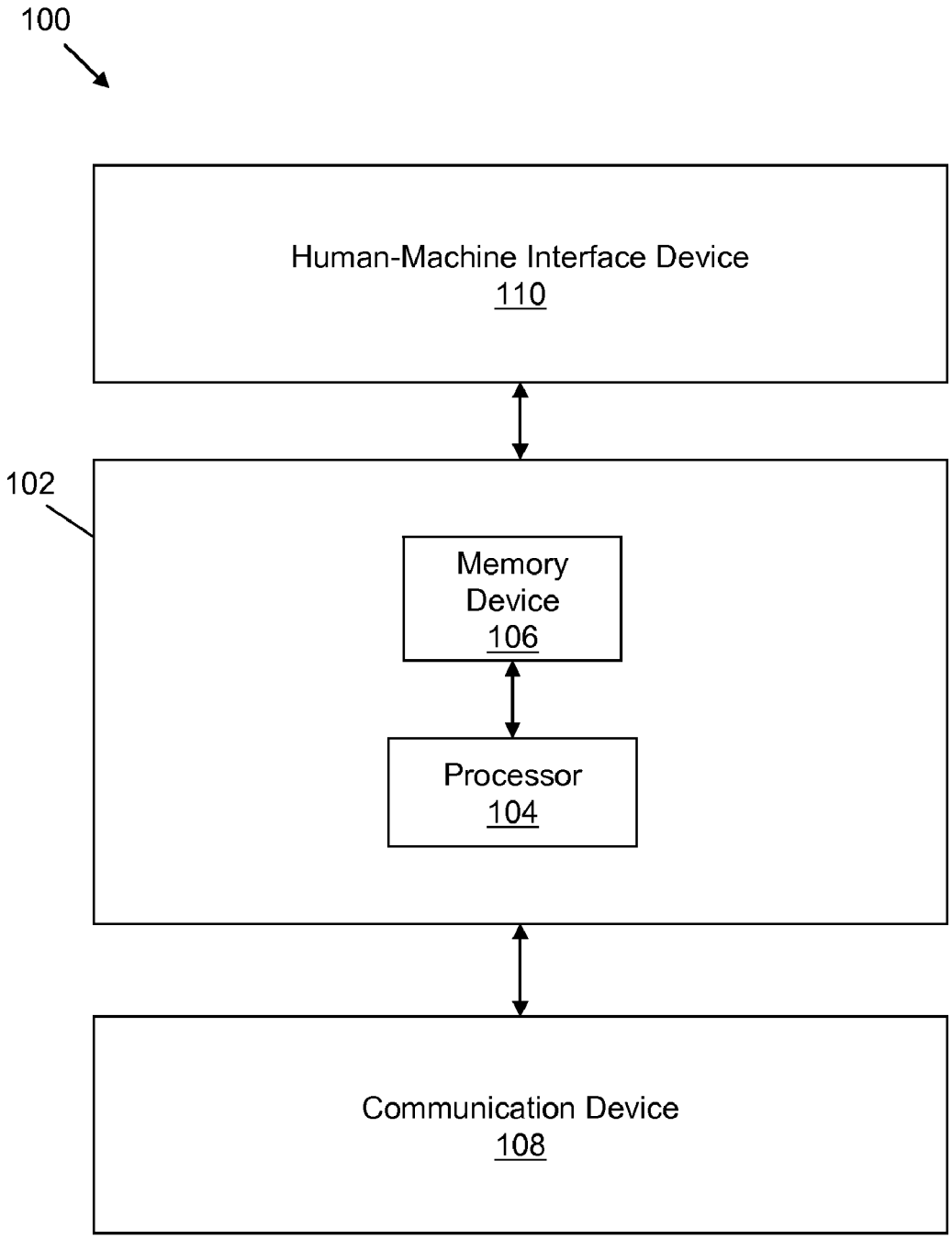
FIG. 1 is a block diagram of one embodiment of a computer system configured to implement a method of prompting a pilot and/or flight crew to respond to a data link message before it expires according to the present disclosure.

FIG. 1 is a block diagram of one embodiment of a computer system 100 configured to implement a method of prompting a pilot and/or flight crew to respond to a data link message before it expires. In some embodiments, the computer system 100 is implemented onboard an aircraft. In other embodiments, the computer system 100 is implemented at an air traffic control center. The computer system 100 includes a processing and storage platform 102 having at least one processor 104 and at least one memory device 106 in operative communication with the at least one processor 104.

The at least one processor 104 is implemented using software, firmware, hardware, or any appropriate combination thereof In example embodiments, the at least one processor 104 includes one or more microprocessors, memory elements, digital signal processing ("DSP") elements, interface cards, and other standard components known in the art. Any of the foregoing may be supplemented by, or incorporated in, specially-designed application-specific integrated circuits ("ASICs") or field programmable gate arrays ("FPGAs"). The at least one processor 104 includes or functions with software programs, firmware, or other computer readable instructions for carrying out various process tasks, calculations, and control functions, used in the method of prompting a pilot and/or flight crew to respond to a data link message before it expires. These instructions are typically tangibly embodied on any appropriate medium used for storage of computer readable instructions or data structures.

The at least one memory device 106 can be implemented with any available computer readable storage media configured to be accessed by a general purpose or a special purpose computer or processor, or any programmable logic device. Suitable computer readable media include storage or memory media such as magnetic or optical media. Storage or memory media include, but is not limited to, conventional hard disks, Compact Discs ("CDs") (including, but not limited to, CD-ROM, CD-R, CD-RW, and the like), Digital Versatile Discs ("DVDs") (including, but not limited to, DVD-ROM, DVD-R, DVD-RW, DVD+R, DVD+RW, DVD-RAM, and the like), Blu-ray Discs (including, but not limited to, Blu-ray Disc Recordable ("BD-R") and Blu-ray Disc Recordable/Erasable ("BD-RE"), and the like), High Definition/Density Digital Versatile Discs ("HD DVDs") (including, but not limited to HD DVD-ROM, HD DVD-R, HD DVD-RW, HD DVD-RAM, and the like), and other optical media, volatile or non-volatile media such as Random Access Memory ("RAM") (including, but not limited to, Synchronous Dynamic Random Access Memory ("SDRAM"), Double Data Rate ("DDR") RAM, and RAMBUS Dynamic RAM ("RDRAM"), Static RAM ("SRAM")), Read Only Memory ("ROM"), Electrically Erasable Programmable ROM ("EEPROM"), flash memory, and the like.) Suitable processor-readable media may also include transmission media such as electrical, electromagnetic, or digital signals, conveyed via a communication medium such as a wired network and/or a wireless network. Combinations of the above are also included within the scope of computer readable media.

The computer system 100 also includes a communication device 108 configured to establish a data link with a remote device. The communication device 108 is further configured to send and receive uplink and downlink messages with the remote device across the data link. In example embodiments, the communication device 108 is a radio transceiver, such as a very high frequency ("VHF") radio transceiver, a high frequency ("HF") radio transceiver, or a satellite communication ("SATCOM") transceiver. In other embodiments, other communication devices are used.

The computer system 100 also includes a human-machine interface device 110, such as a multi-control display unit ("MCDU") or a multi function display ("MFD") system as are known in the art. The human-machine interface device 110 is configured to allow an operator, such as a pilot and/or flight crew or an air traffic controller, to interface with the processing and storage platform 102. Typically, the human-machine interface device 110 includes a display configured to display information to the operator and an input device, such as a keyboard or plurality of buttons, configured to receive input from the operator. In example embodiments, the human-machine interface device 110 is configured for audio output in addition to, or in lieu of, the display. Specifically, in example embodiments the human-machine interface device 110 includes, or is coupled with, speakers, buzzers, sirens, or horns. In specific examples, at least one speaker is included to employ text to speech reading of information to audibly and autonomously announce an expiration notice through the at least one speaker and to audibly and autonomously prompt the operator for the input through the speaker. In example embodiments, the human-machine interface device 110 is configured for voice or other audio input, such as voice recognition of commands. Specifically, the human-machine interface device 110 includes, or is coupled with at least one microphone used to employ voice recognition input of commands from the operator.

The computer system 100 is capable of sending and receiving data link messages through the communication device 108. Once a data link message is received, it is shown to the operator through the human-machine interface device 110. The operator can then respond to the data link message through the human-machine interface device 110. In example embodiments according to this disclosure, the processing and storage platform 102 carries out the method of prompting a pilot and/or flight crew to respond to a data link message before it expires described in detail below. The processing and storage platform 102 starts a timer when the data link message is received and prompts the operator to respond to the data link message at a predefined time before the timer expires via the human-machine interface device 110. If a response is input by the operator before the timer expires, a responsive data link message is sent via the communication device 108. If a response is not input by the operator before the timer expires, the data link message is set as expired.

Figure 2:
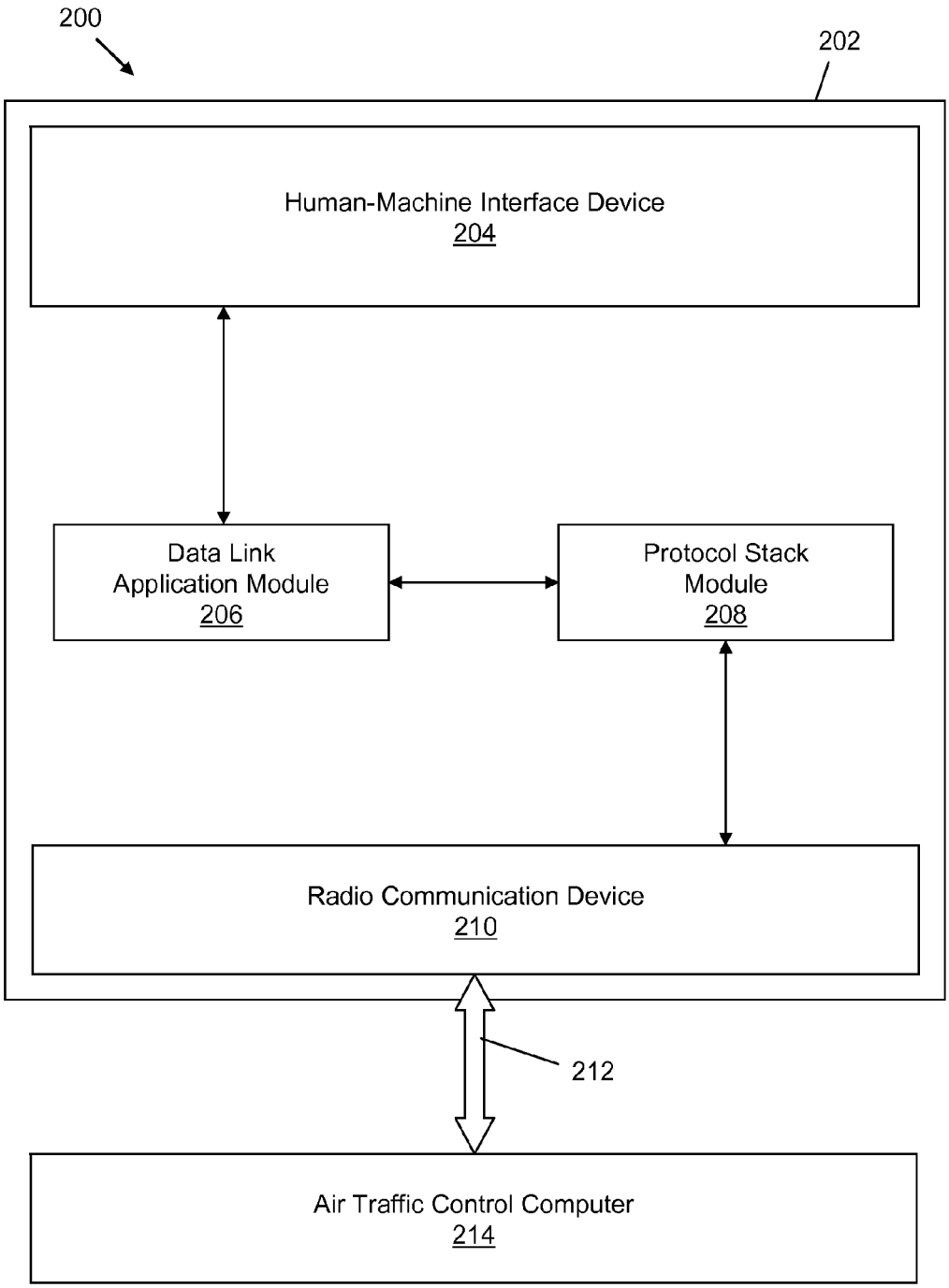
FIG. 2 is a block diagram of another example embodiment of a computer system implemented on an aircraft and configured to carry out a method of prompting a pilot and/or flight crew to respond to a data link message before it expires.

FIG. 2 is a block diagram of an embodiment of a computer system 200 configured to implement a method of prompting a pilot and/or flight crew to respond to a data link message before it expires. The computer system 200 shown in FIG. 2 is implemented onboard an aircraft 202. In other embodiments, the computer system 200 is implemented onboard other vehicles, such as sea vessels, spacecraft, and ground vehicles, or implemented in an air traffic control computer or other computing system at an air traffic control center or other stationary installation. The computer system 200 includes at least one human-machine interface device 204, at least one data link application module 206, at least one protocol stack module 208, and at least one radio communication device 210. The human-machine interface device 204 is configured to allow an operator, such as a pilot and/or flight crew or air traffic controller, to interface with the at least one data link application module 206. The human-machine interface device 204 is typically configured similar to the human-machine interface device 110 shown in FIG. 1 and described above.

The at least one data link application module 206 is configured to interact with the human-machine interface device 204 to display received data link messages and to send data link messages input by the operator. Typically, the at least one data link application module 206 interfaces directly with the human-machine interface device 204, as shown in FIG. 2. In other examples, an intermediary module interfaces between the human-machine interface device 204 and the at least one data link application module 206. The at least one data link application module 206 leverages the at least one protocol stack module 208 to send and receive information to and from devices external to the aircraft 202. The at least one protocol stack module 208 is typically a software implementation of a set of network protocols that work together to facilitate data communication to and from the at least one data link application module 206 of the computer system 200. Typically, the at least one protocol stack module 208 sends downlinks and receives uplinks for the at least one data link application module 206 via the at least one radio communication device 210. In embodiments implemented in air traffic control computers, the at least one protocol stack module 208 typically sends uplinks and receives downlinks for the at least one data link application module 206 via the at least one radio communication device 210.

The at least one data link application module 206 typically includes a Controller Pilot Data Link Communication application. The Controller Pilot Data Link Communications application in the at least one data link application module 206 enables transmission and reception of Controller Pilot Data Link Communications data link messages. The Controller Pilot Data Link Communications application of the at least one data link application module 206 is typically hosted as an application on one of several computing devices included in the aircraft 202. The at least one data link application module 206 and the at least one protocol stack module 208 can be implemented in a variety of ways using a variety of computing devices, which will be discussed in further detail with regard to FIGS. 3-6 below.

The at least one radio communication device 210 includes a Very High Frequency ("VHF") radio transceiver, a High Frequency ("HF") radio transceiver, and a Satellite Communication ("SATCOM") radio transceiver. The at least one radio communication device 210 establishes and communicates across a data link 212 with an air traffic control computer 214 at an air traffic control center. In other embodiments, greater or fewer radio communication devices of any suitable type, or other communication devices not implementing radio communication, are included in the at least one radio communication device 210. In other embodiments, the at least one radio communication device 210 establishes and communicates across the data link 212 with another device which may be positioned as part of an aeronautical operational control ("AOC") base, an airline administrative control ("AAC") base, or any other appropriate entity.

FIGS. 3-6 show specific implementations of the example computer system 200 configured to implement a method of prompting a pilot and/or flight crew to respond to a data link message before it expires. Each specific implementation shown in FIGS. 3-6 implement the example computer system 200 in different ways.

Figure 3:
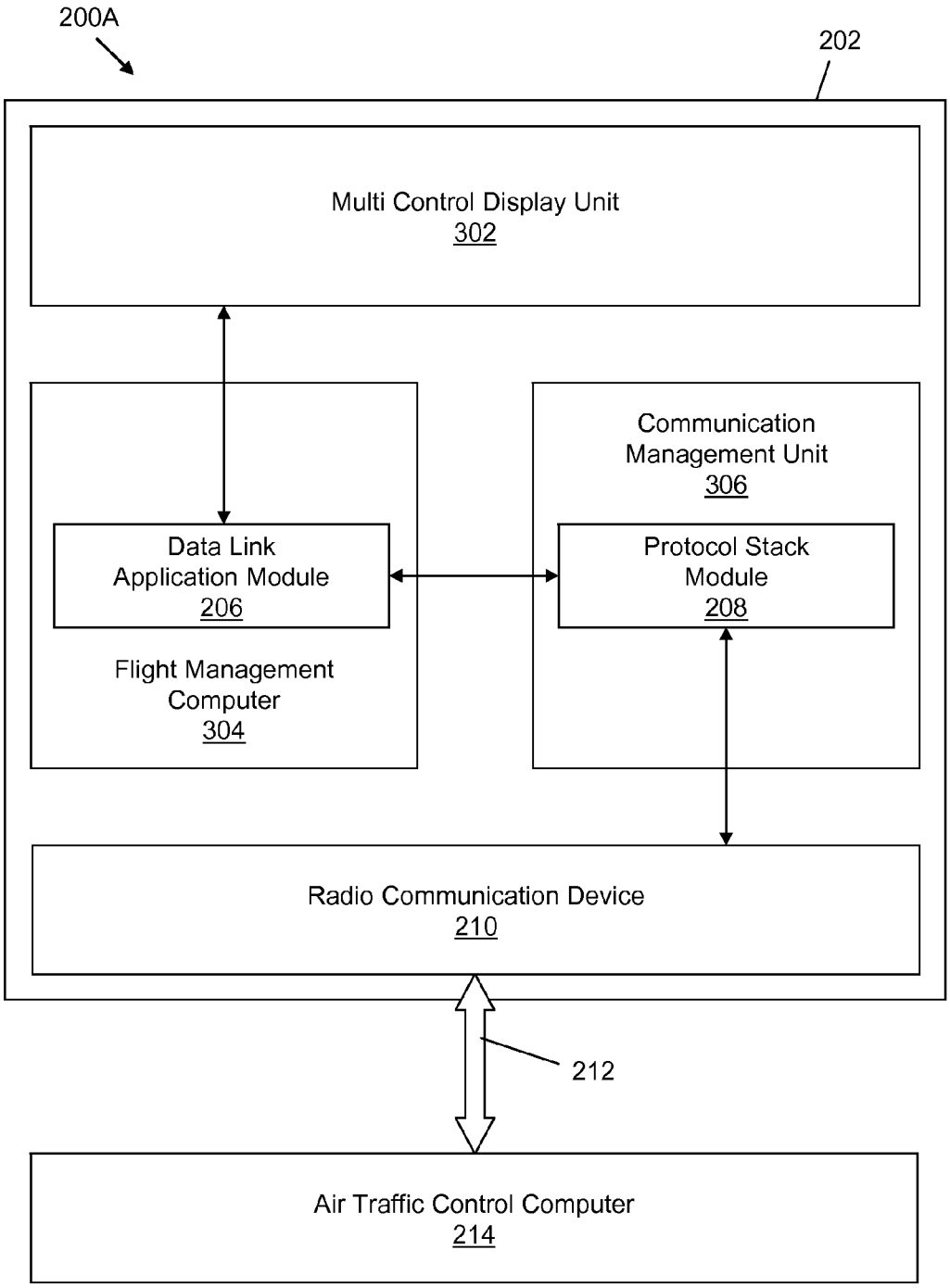
FIG. 3 is a block diagram of a specific implementation of the example computer system of FIG. 2 implemented in both a flight management computer and a communication management unit on an aircraft.

FIG. 3 is a block diagram of a computer system 200A, a specific implementation of the example computer system 200. The computer system 200A is implemented onboard the aircraft 202. The computer system 200A includes a multi control display unit 302, a flight management computer 304, and a communication management unit 306.

The multi control display unit 302 is a human-machine interface device often found onboard modern aircraft. The multi control display unit 302 is configured to act as the interface between the pilot and/or flight crew and the flight management computer 304. The flight management computer 304 includes a processor and memory, such as the processing and storage platform 102 of computer system 100 described above. The flight management computer 304 is typically configured to aid in navigation, surveillance, and flight planning onboard the aircraft. Pilot and/or flight crew use the flight management computer 304 to create flight plans including way points with corresponding altitudes and times, which are subsequently and autonomously carried out by the flight management computer 304. The flight management computer 304 is configured to host various applications, such as the at least one data link application module 206. In computer system 200A, the flight management computer 304 hosts a Controller Pilot Data Link Communications application as part of the at least one data link application module 206. In other embodiments, described in further detail below, the Controller Pilot Data Link Communications application and the at least one data link application module 206 are hosted by other computer systems.

The communication management unit 306 also includes a processor and memory device, such as the processing and storage platform 102 of computer system 100 described above. The at least one protocol stack module 208 typically runs as a process on the communication management unit 306. The communication management unit 306 is typically configured to route data communication traffic to and from the at least one radio communication device 210 via the at least one protocol stack module 208. Specifically, the Controller Pilot Data Link Communications messages to and from the Controller Pilot Data Link Communications application included in the at least one data link application module 206 are communicated through the at least one protocol stack module 208 hosted by the communication management unit 306.

The at least one protocol stack module 208 hosted by the communication management unit 306 implements a computer networking protocol suite designed for aircraft data link applications, such as Aircraft Communications Addressing and Reporting System ("ACARS") or the Aeronautical Telecommunications Network ("ATN"). The at least one protocol stack module 208 sends and receives Controller Pilot Data Link Communications messages to and from the Controller Pilot Data Link Communications application of the at least one data link application module 206 hosted in the flight management computer 304. The at least one protocol stack module 208 hosted in the communication management unit 306 sends downlinks and receives uplinks via the at least one radio communication device 210. The remainder of the interaction between the at least one radio communication device 210 and the air traffic control computer 214 across the data link 212 is the same for computer system 200A as described above for computer system 200.

Figure 4:
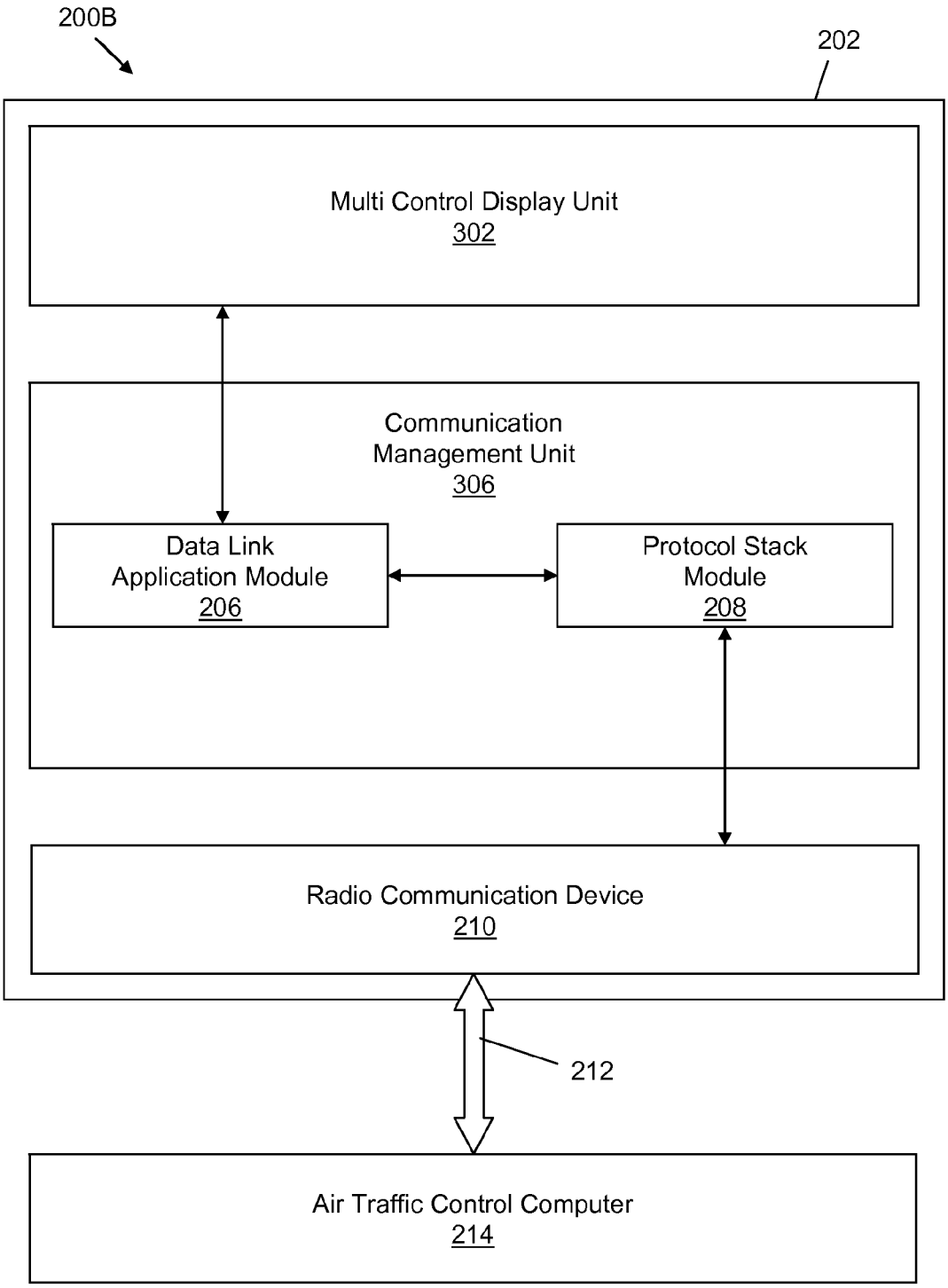
FIG. 4 is a block diagram of a specific implementation of the example computer system of FIG. 2 implemented in a communication management unit on an aircraft.

FIG. 4 is a block diagram of a computer system 200B, a specific implementation of the example computer system 200. The computer system 200B is implemented onboard the aircraft 202. As with computer system 200A, the computer system 200B includes the multi control display unit 302 and the communication management unit 306.

A flight management computer is not included in computer system 200B, though the aircraft 202 may include a flight management computer for other purposes. In computer system 200B, the communication management unit 306 includes a processor and a memory device, such as the processing and storage platform 102 described above. Further, the communication management unit 306 is configured to both host the at least one data link application module 206 and to route data communication traffic to and from the at least one radio communication device 210 via the at least one protocol stack module 208. Specifically, messages to and from the Controller Pilot Data Link Communications application of the at least one data link application module 206 hosted in the communication management unit 306 will be communicated through the at least one protocol stack module 208 also hosted by the communication management unit 306.

The at least one data link application module 206 interacts with the at least one protocol stack module 208 and multi control display unit 302 in the same ways as it does in the computer system 200A described above. The difference between the computer system 200A and the computer system 200B is where the at least one data link application module 206 is hosted. In computer system 200A, the at least one data link application module 206 is hosted in the flight management computer 304. In computer system 200B, the at least one data link application module 206 is hosted in the communication management unit 306. The remainder of computer system 200B is the same as computer system 200A described above.

Figure 5:
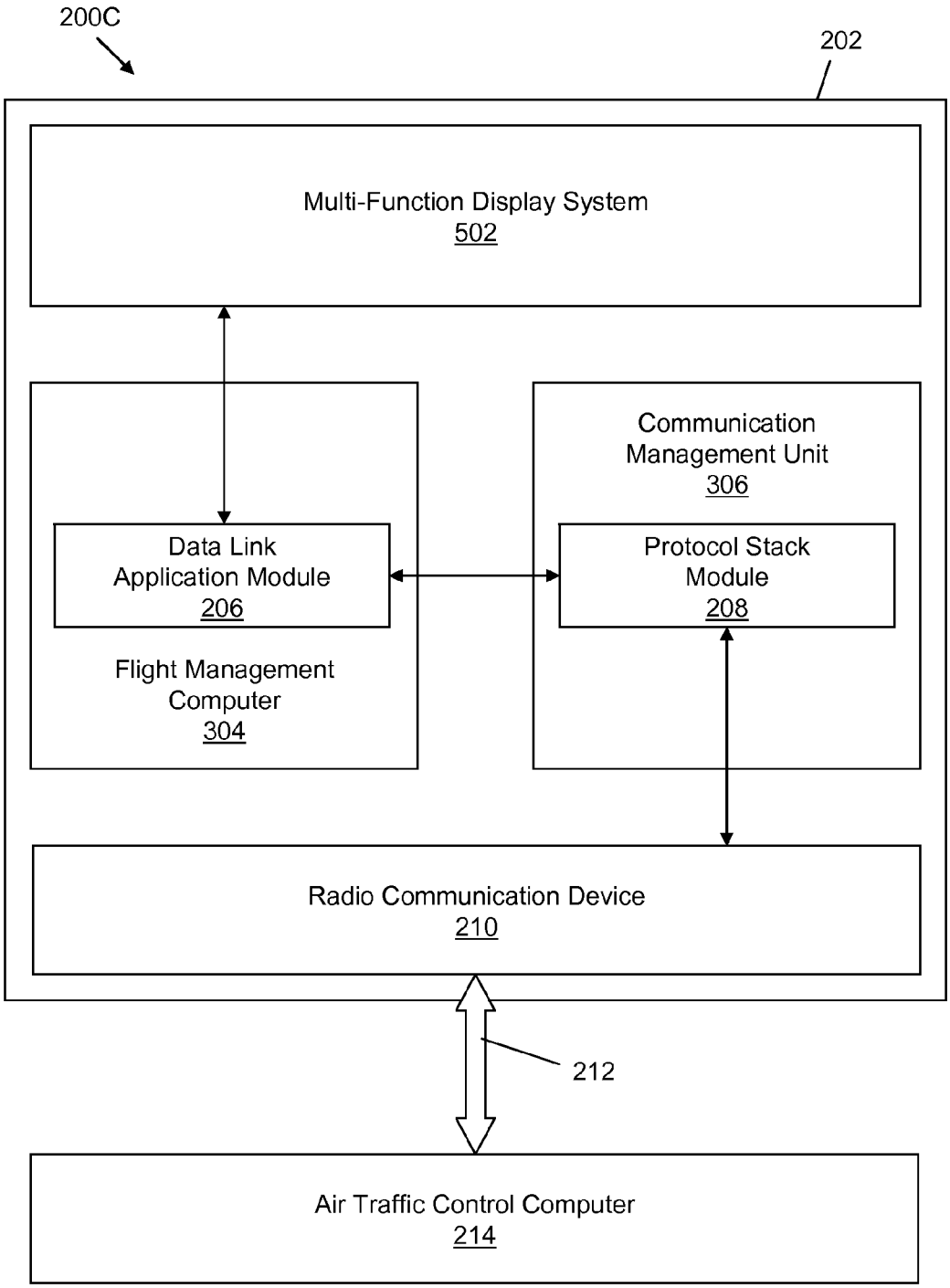
FIG. 5 is a block diagram of a specific implementation of the example computer system of FIG. 2 implemented in both a flight management computer and a communication management unit on an aircraft.

FIG. 5 is a block diagram of a computer system 200C, a specific implementation of the example computer system 200. The computer system 200C is implemented onboard the aircraft 202. The computer system 200C includes a multi-function display system 502 instead of the multi control display unit 302 included in the computer system 200A and the computer system 200B. The multi function display system 502 is an alternative to the multi control display unit 302. The multi function display system 502 typically includes a display, a keyboard, and a cursor control. In some embodiments, the keyboard is a multi-control display unit keyboard. Like the multi control display unit 302, the multi function display system 502 allows the operator to interact with the flight management computer 304. The multi function display system 502 displays information to the operator and accepts input from the operator via the keyboard and cursor control.

In example embodiments, the multi function display system 502 includes other output and input devices, such as speakers and microphones respectively. In example embodiments of the multi function display system 502 having speakers and microphones, a text to speech engine is implemented to read data link messages to the operator and a voice recognition engine is implemented to allow the operator to respond with voice cues and commands. The remainder of computer system 200C is the same as computer system 200A described above.

Figure 6:
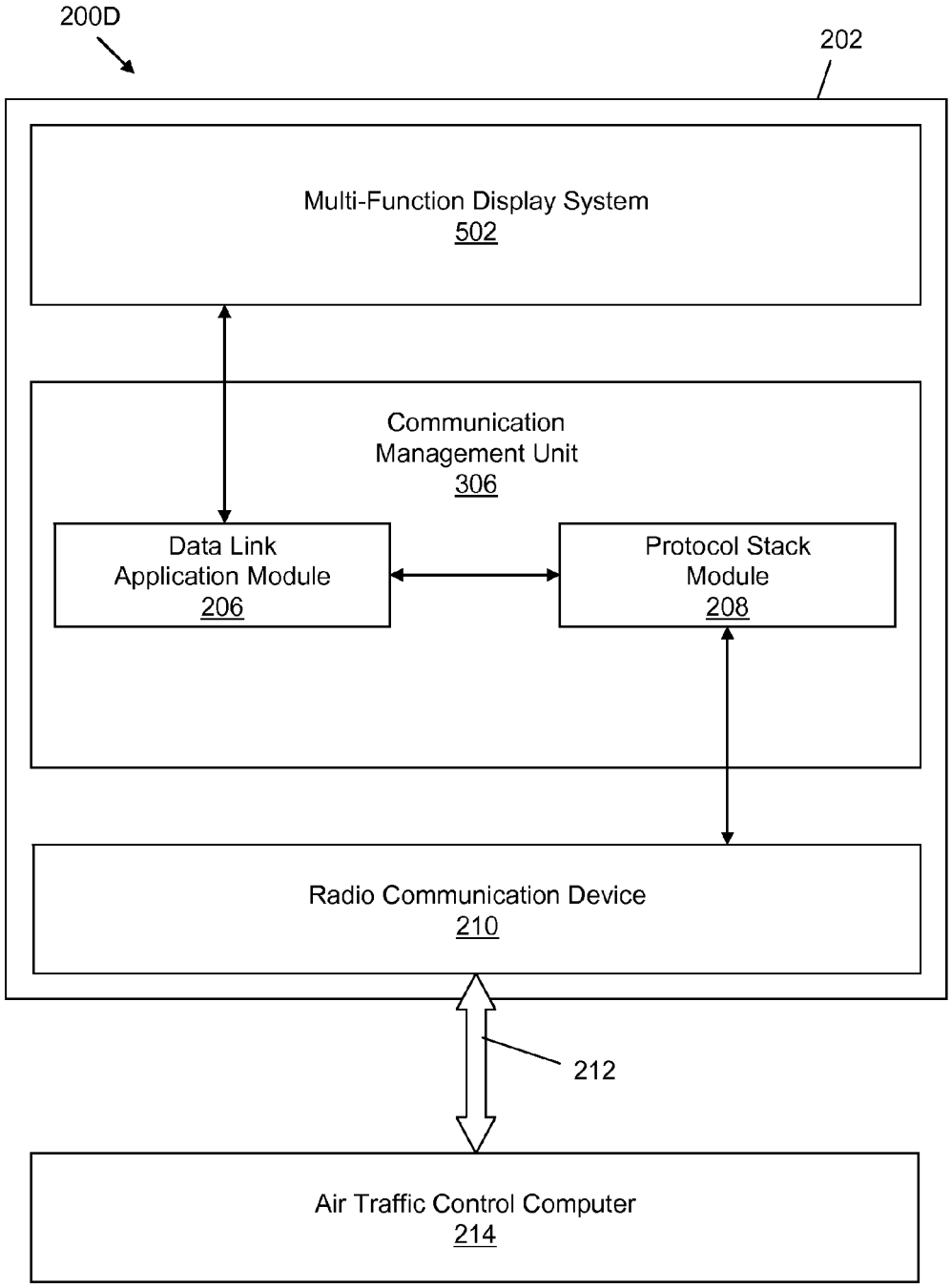
FIG. 6 is a block diagram of a specific implementation of the example computer system of FIG. 2 implemented in a communication management unit on an aircraft.

FIG. 6 is a block diagram of a computer system 200D, a specific implementation of the example computer system 200. The computer system 200A is implemented onboard the aircraft 202. As with the computer system 200C, the computer system 200D includes the multi function display system 502 described in detail above with reference to the computer system 200C. The remainder of computer system 200D is the same as computer system 200B described above.

In other embodiments, the at least one data link application module 206 is implemented as a communication management function ("CMF") hosted by an integrated platform, as a flight management function ("FMF") hosted by an integrated platform, or in any other avionics computer in the aircraft 202. In other embodiments, the at least one protocol stack 208 is implemented as a communication management function hosted by an integrated platform. In other embodiments, a computer system similar to the example computer system 200 shown in FIGS. 2-6 and discussed above is implemented at an air traffic control center or for use between other vehicles and control centers. The example computer systems 100 and 200, shown in FIGS. 1-6 and described above, can be a part of the communication protocols for future air navigation systems ("FANS") systems, aeronautical telecommunication network ("ATN") systems, and Aircraft Communications Addressing and Reporting System ("ACARS").

Figure 7:
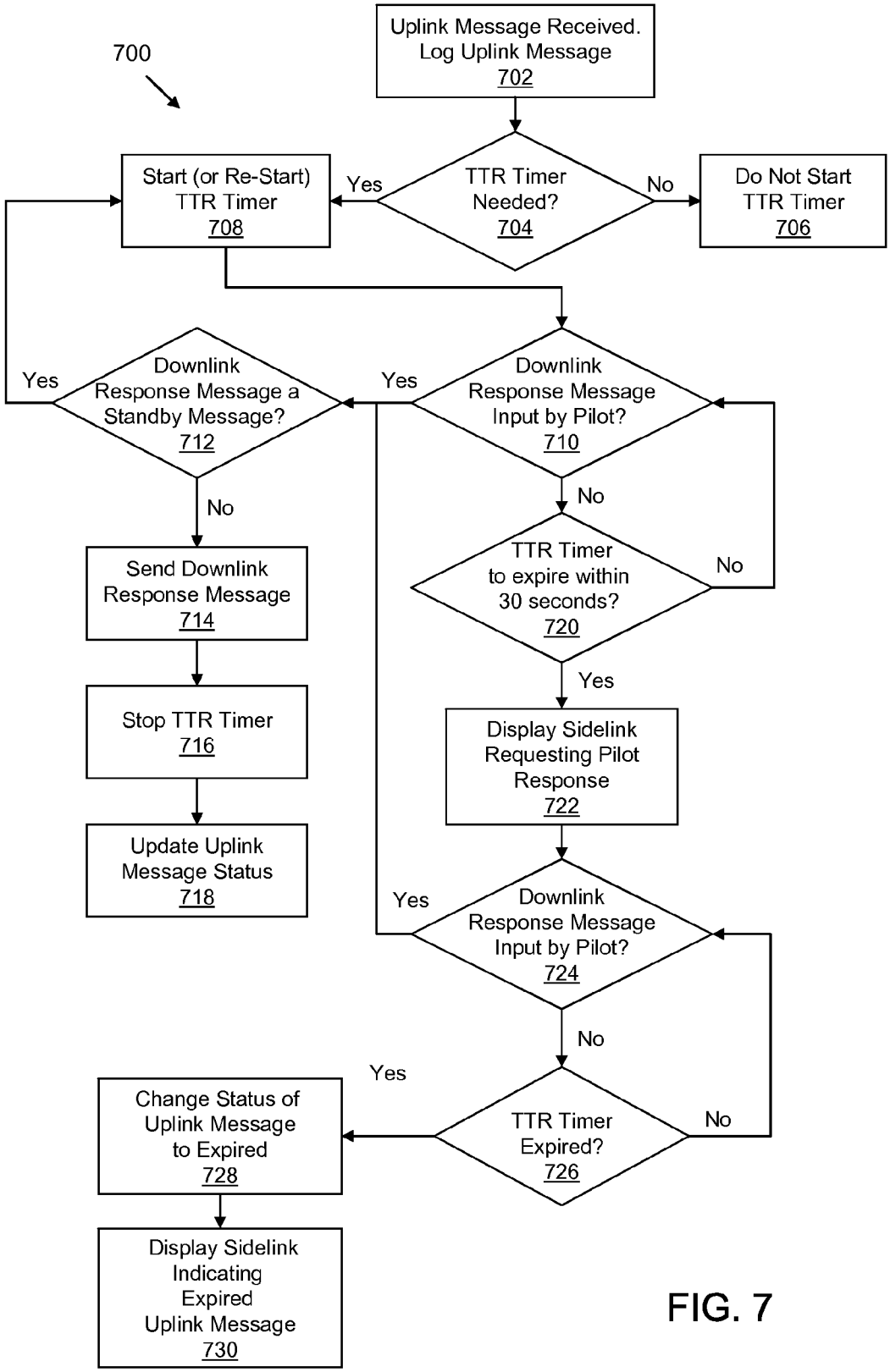
FIG. 7 is a flow diagram showing one embodiment of a method for prompting an operator to reply to a data link message before it expires.

FIG. 7 is a flow diagram showing one embodiment of an example method 700 for prompting an operator to reply to a data link message before it expires. Although the method 700 of FIG. 7 describes messages received at an aircraft by pilots and/or flight crew, the method is also applicable to messages received at an air traffic control center by an air traffic controller or to messages received by operators of other vehicles or other control center personnel. The example method 700 for prompting an operator to reply to a data link message before it expires is described with reference to the example computer system 200A shown in FIG. 3. In specific embodiments, the logic of the method 700 is primarily executed by the at least one data link application module 206, including the Controller Pilot Data Link Communications application, hosted by the flight management computer 304. In other embodiments, other methods similar to the example method 700 can be implemented using any other system according to the present disclosure, including, but not limited to the embodiments of computer systems 100 and 200 shown in FIGS. 1-6 and described above.

The method 700 begins at block 702, where an uplink message is received via the at least one protocol stack module 208 of the communication management unit 306 from the data link 212. Once received, the uplink message is stored in a message log typically implemented in the at least one data link application module 206 hosted on the flight management computer 304. The method 700 proceeds to block 704, where it is determined whether a termination timer, receiver ("TTR timer") is needed. The TTR timer associated with a particular uplink message is typically used to count down the time since the particular uplink message was received. The TTR timer is typically implemented in the at least one data link application module 206 hosted on the flight management computer 304. A TTR timer is typically needed when the received message requires a response from the pilots and/or flight crew. A TTR timer is typically not needed when the received message does not require a response. In some embodiments, messages that do not require a TTR timer are pre-defined with a response type of "N." In cases where a TTR timer is unnecessary, the method 700 branches to block 706, where a TTR is not started and the method 700 completes for the uplink message received at block 402.

If it is determined at block 704 that a TTR timer is needed, the method 700 branches to block 708, where a TTR timer is started in the at least one data link application module 206 hosted on the flight management computer 304. The method 700 then proceeds to block 710, where it is determined whether a downlink response message has been input by the pilot and/or flight crew. The at least one data link application module 206 hosted by the flight management computer 304 typically makes this determination. The pilot and/or flight crew typically input the downlink response message using the inputs on the multi control display unit 302. In example embodiments, the pilot and/or flight crew can input various downlink response messages, such as ACCEPT, REJECT, or STANDBY. An example interface for the multi control display unit 302 is shown in further detail in FIGS. 8-9 and described below.

If it is determined that a downlink response message has been input by the pilot and/or flight crew at block 710, the method 700 branches to block 712, where it is determined whether the downlink response message input by the pilot and/or flight crew is a standby message. Typically, this determination is made by the at least one data link application module 206 hosted by the flight management computer 304. If it is determined that the downlink response message input by the pilot and/or flight crew is a STANDBY message, the method 700 returns to block 708, where the TTR timer is restarted by the at least one data link application module 206 hosted by the flight management computer 304. The STANDBY message is typically used by the pilot and/or flight crew to indicate to the air traffic controller stationed at the air traffic control center, that the pilot and/or flight crew needs more time to respond to the uplink message and the TTR timer is restarted.

If it is determined at block 712 that the downlink response message input by the pilot and/or flight crew is not a STANDBY message, then the method 700 branches to block 714 where the downlink response input by the pilot and/or flight crew is sent through the at least one protocol stack module 208 and across the data link 212 via the at least one radio communication device 210 to the air traffic controller stationed at the air traffic control computer 214. The determination at block 712 is typically made by the at least one data link application module 206 hosted on the flight management computer 304. The method 700 proceeds from block 714 to block 716, where the TTR timer is stopped by the at least one data link application module 206. The method 700 proceeds further from block 716 to block 718, where the message status of the uplink message is updated appropriately by the at least one data link application module 206 hosted by the flight management computer 304. For example, if the downlink response message input by the pilot and/or flight crew was ACCEPT, the message status of the uplink message is changed by the at least one data link application module 206 to ACCEPTED. Similarly, if the downlink response message input by the pilot and/or flight crew was REJECT, the message status of the uplink message is changed by the at least one data link application module 206 to REJECTED. In other implementations, the message status of both accepted and rejected messages is changed to another indicator, such as CLOSED.

If it is determined at block 710, by the at least one data link application module 206, that the downlink response message has not been input by the pilot and/or flight crew, the method 700 proceeds to block 720. At block 720, the at least one data link application module 206 determines whether the TTR timer will expire within a predefined time duration of 30 seconds. In other embodiments, the predefined time duration is longer or shorter than 30 seconds. The predefined time duration is typically set between ¼ and ½ of the total TTR timer value. The total TTR timer value is typically between about 20 seconds and about 1100 seconds. The total TTR timer value is described, and example total TTR timer values are outlined, in further detail in *Interoperability Requirements Standard for Aeronautical Telecommunication Network Baseline* 1, RTCA, Inc., vol. 1, sec. 4.2.1, pp. 102-107 (2007), which is incorporated by reference herein. The predefined time duration is preferably no shorter than 15 seconds. The predefined time duration is designed to give the pilot and/or flight crew enough time to respond to the uplink message without being too far in advance of the TTR timer expiration.

If it is determined at block 720 that the TTR timer will not expire within the 30 second predefined time duration, the method 700 returns to block 710, where it is again determined whether the downlink response message has been input by the pilot and/or flight crew. The determination of whether the TTR timer will expire within the 30 second predefined time duration is typically made by the at least one data link application module 206. If it is determined at block 720 that the TTR timer will expire within the 30 second predefined time duration, the method 700 branches to block 722, where text is displayed on the multi control display unit 302 as a sidelink.

The term "sidelink" as used herein typically refers to a data communications related message sent automatically from computer systems onboard the aircraft to the pilot and/or flight crew onboard the aircraft 202. In embodiments implemented at an air traffic control center, the "sidelink" refers to messages sent automatically from computer systems at the air traffic control center to an air traffic controller stationed at an air traffic control center. In example embodiments, the sidelink messages are treated similarly to uplink messages and downlink messages. The sidelink text displayed on the multi control display unit 302 notifies the pilot and/or flight crew when the TTR timer will expire, displays the original uplink message, and prompts the pilot and/or flight crew for a response to the original uplink message. Thus, the pilots and/or flight crew need not go to the message log to find the message, because it is already provided in the "sidelink." The at least one data link application module 206 hosted by the flight management computer 304 typically controls the text displayed on the multi control display unit 302.

The method proceeds to block 724, where it is determined whether a downlink response message has been input by the pilot and/or flight crew. This determination is typically made by the at least one data link application module 206 hosted by the flight management computer 304. If it is determined that a downlink response message has been input by the pilot and/or flight crew at block 724, the method 700 branches to block 712, where it is determined by the at least one data link application module 206 whether the downlink response message input by the pilot and/or flight crew is a standby message. The method 700 flows from block 712 as described above. If it is determined that a downlink response message has not been input by the pilot and/or flight crew at block 724, the method 700 branches to block 726, where it is determined whether the TTR timer has expired. The determination of whether the TTR timer has expired or not is typically made by the at least one data link application module 206 hosted by the flight management computer 304. If it is determined that the TTR timer has not expired at block 724, the method 700 returns to block 724. If it is determined that the TTR timer has expired at block 726, the method 700 branches to block 428, where the status of the uplink message is changed to EXPIRED by the at least one data link application module 206. In other embodiments, the status of the expired uplink message is changed to another indicator, such as CLOSED. The method 700 subsequently proceeds to block 730, where text is displayed on the multi control display unit 302 as a sidelink, indicating to the pilot and/or flight crew that the uplink message has expired. As noted above, the at least one data link application module 206 hosted by the flight management computer 304 typically controls the sidelink text displayed on the multi control display unit 302.

The method 700 repeats for each new uplink received that requires a response, such that multiple TTR timers are running in the at least one data link application module 206 for multiple received uplink messages. Though method 700 was described in terms of the computer system 200A, in other embodiments, similar methods are implemented in other computer systems, such as the embodiments of computer systems 100 and 200 shown in FIGS. 1-6, and on other vehicles and at stationary structures, such as air traffic controller command centers.

The method 700 is implemented in the aircraft 202 by modifying conventional avionics and aircraft control software to add appropriate logic to perform the method 700. The method 700 can be implemented for an air traffic control system on the ground by modifying the air traffic controller workstation software to add logic to perform the method 700. It should be understood that the avionics and ground implementations of the method 700 utilize the same unique features but are independent of each other. Thus, the method 700 can function even if only one of the aircraft or the air traffic controller control system has been implemented with software for performing the method.

Figure 8:
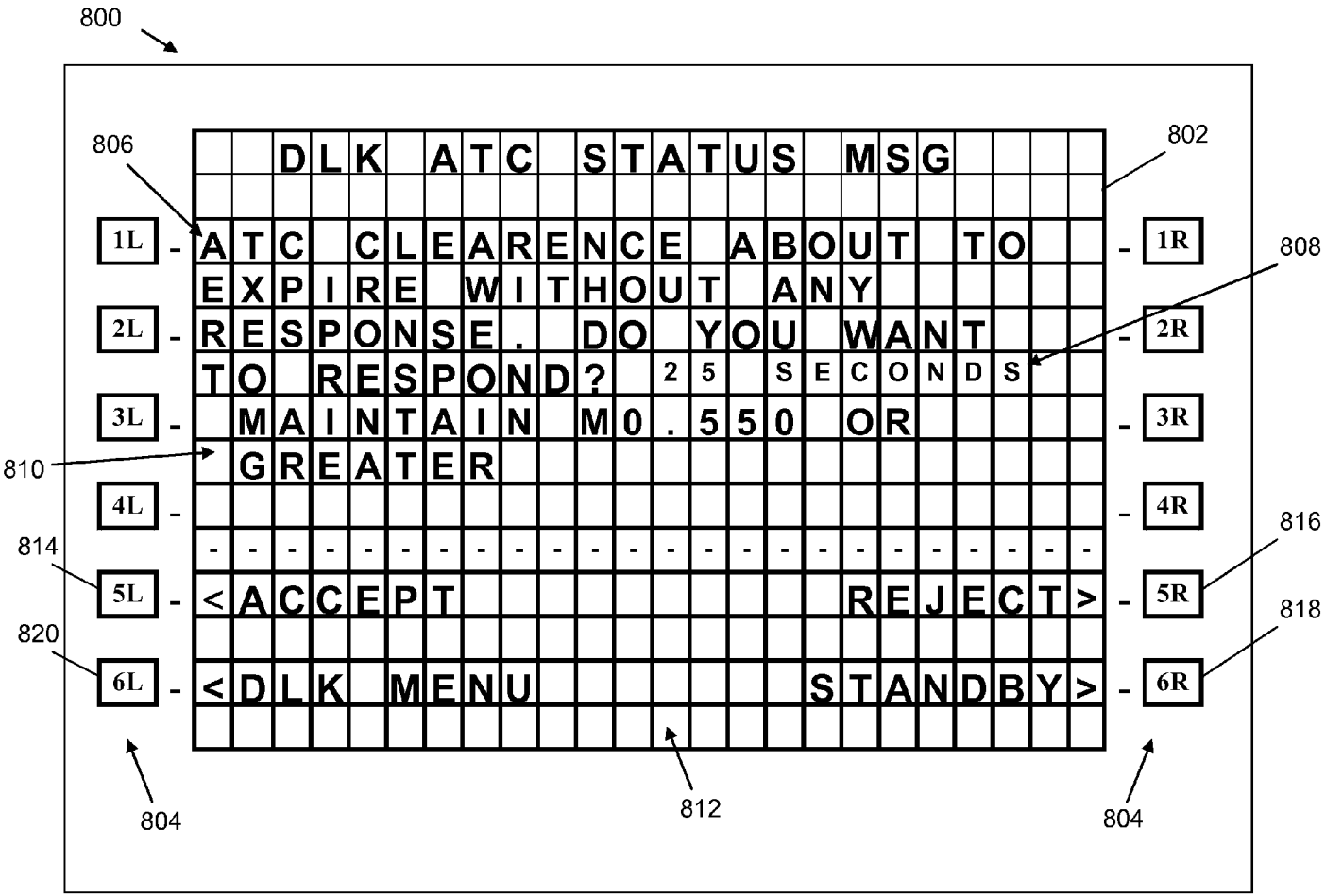
FIG. 8 shows an example human-machine interface implementing the method of FIG. 7 before a data link message expires.

FIG. 8 is specific implementation of an example human-machine interface 800 shown on the multi control display unit 302 soon before a TTR timer is about to expire on an uplink message. In other embodiments, the example human-machine interface 800 is implemented on the multi function display system 502 or another human-machine interface device 204. Typically, the flight management computer 304 and the communication management unit 306 support Controller Pilot Data Link Communications (including both FANS and ATN versions) and are configured to use sidelink or communication system alert messages to alert pilot and/or flight crew of system messages and status. The example human-machine interface 800 is enhanced over current sidelink alert systems to prompt pilot and/or flight crew for a response soon before a downlink message expires, according to the method 700 described above.

The example human-machine interface 800 shows a sidelink displayed on the multi control display unit 302. The multi control display unit 302 includes a display 802 and a plurality of buttons 804 on each side of the display 802. In FIG. 8, the human-machine interface 800 shows an expiration notice message 806 to the pilot and/or flight crew indicating that a particular downlink message will expire soon:

DLK ATC STATUS MSG

ATC CLEARANCE ABOUT TO EXPIRE WITHOUT ANY RESPONSE. DO YOU WANT TO RESPOND?

The expiration notice message 806 of the human-machine interface 800 includes the time until expiration 808 on the display 802 of the example human-machine interface 800. The time until expiration 808 is the amount of time left before the particular downlink message will expire, which is "25 SECONDS" in the specific example of the embodiment shown in FIG. 8. In addition to the expiration notice message 806, the human-machine interface 800 shows the particular downlink message 810 that will soon expire on the display 802, which is "MAINTAIN M0.550 OR GREATER".

In addition to displaying the expiration notice message 806 and the particular downlink message 810 that will soon expire, the human-machine interface 800 displays several input options associated with some of the buttons 804 in an input option area 812. Specifically, a first button 814 is associated with an "ACCEPT" input option, a second button 816 is associated with a "REJECT" input option, a third button 818 is associated with a "STANDBY" input option, and a fourth button 820 is associated with a "DLK MENU" input option. If the pilot and/or flight crew selects the first button 814 associated with the "ACCEPT" input option, the ACCEPT downlink response message is sent at block 714, the TTR timer is stopped at block 716, and the message status for the particular downlink message 810 is updated to "ACCEPTED" at block 718. If the pilot and/or flight crew selects the second button 816 associated with the "REJECT" input option, the REJECT downlink response message is sent at block 714, the TTR timer is stopped at block 716, and the message status for the particular downlink message 810 is updated to "REJECTED" at block 718. If the pilot and/or flight crew selects the third button 818 associated with the "STANDBY" input option, the TTR timer is restarted at block 708. If the pilot and/or flight crew selects the fourth button 820 associated with the "DLK MENU" input option, the display 802 is updated to display the main data link menu, where the pilots and/or flight crew can select other options in the high level menu structure.

Figure 9:
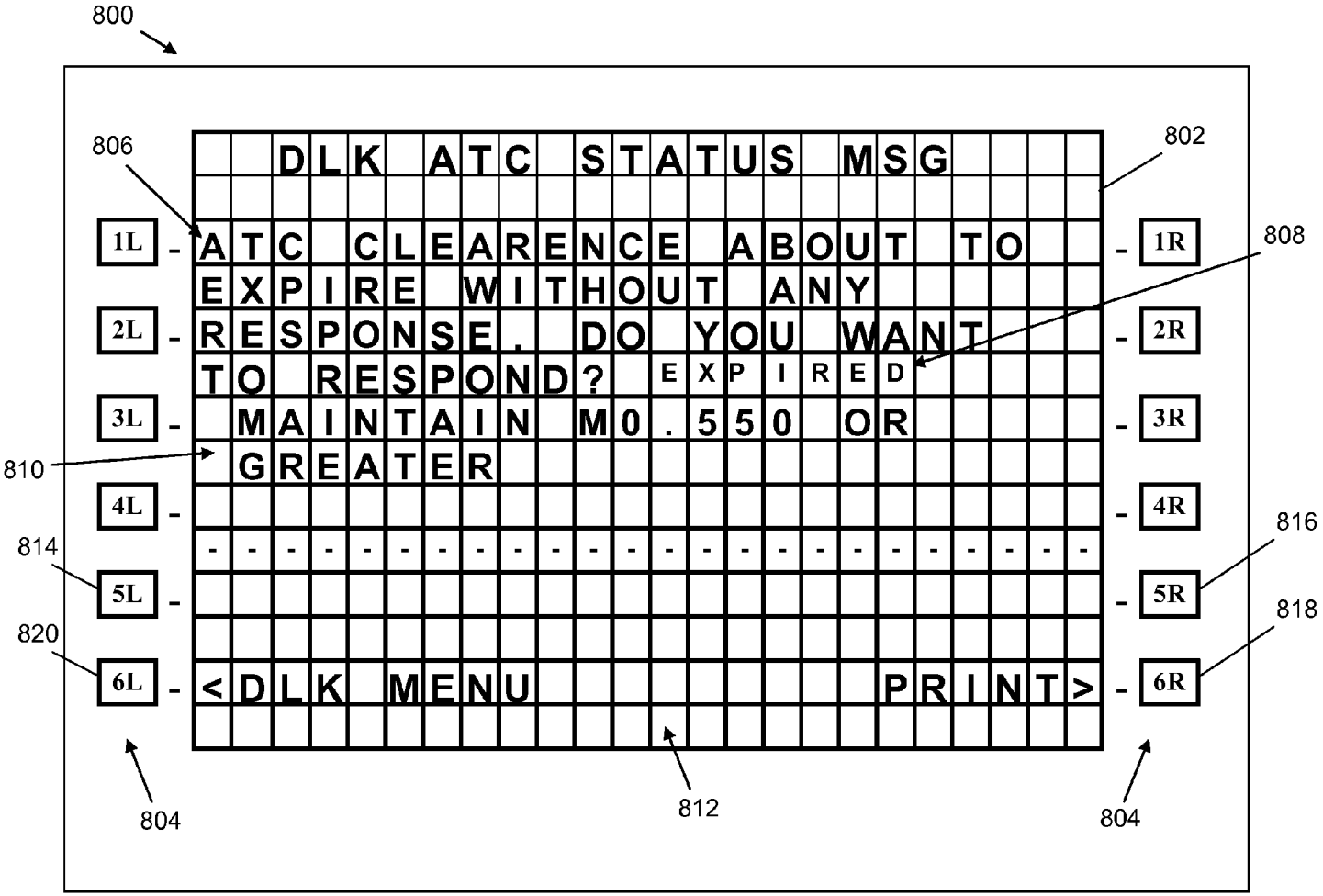
FIG. 9 shows the example human-machine interface of FIG. 8 after the data link message expires.

FIG. 9 is a specific implementation of the example human-machine interface 800 shown on the multi control display unit 302 after a TTR timer expires on an uplink message. If the pilot and/or flight crew does not select the first button 814 associated with the "ACCEPT" input option, the second button 816 associated with the "REJECT" input option, or the third button 818 associated with the "STANDBY" input option before the TTR timer expires, then the uplink message status is changed to EXPIRED at block 728 of the method 700 and the sidelink page is updated on the display 802 of the multi control display unit 302 to show the example human-machine interface 800 of FIG. 9. The example human-machine interface 800 shows a sidelink page displayed on the multi control display unit 302. In FIG. 9, the human-machine interface 800 shows the expiration notice message 806 to the pilot and/or flight crew indicating that a particular downlink message will expire soon:

DLK ATC STATUS MSG

ATC CLEARANCE ABOUT TO EXPIRE WITHOUT ANY RESPONSE. DO YOU WANT TO RESPOND?

The expiration notice message 806 of the human-machine interface 800 in FIG. 9 includes the text "EXPIRED" as the time until expiration 808 on the display 802 of the example human-machine interface 800. In other implementations and embodiments, a different expiration notice message 806 is used to indicate that the particular downlink message has already expired. In addition to the expiration notice message 806, the human-machine interface 800 shows the particular downlink message 810 that has expired on the display 802, which is "MAINTAIN M0.550 OR GREATER".

In addition to displaying the expiration notice message 806 and the particular downlink message 810 that has expired, the human-machine interface 800 displays several input options associated with some of the buttons 804 in an input option area 812. Specifically, the third button 818 is associated with a "PRINT" input option, and the fourth button 820 is associated with a "DLK MENU" input option. If the pilot and/or flight crew selects the third button 818 associated with the "PRINT" input option, the text on the display 802 is printed to a printer or a file. If the pilot and/or flight crew selects the fourth button 820 associated with the "DLK MENU" input option, the display 802 is updated to display the main data link menu.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A method for prompting an operator to reply to a first data link message before it expires, the method comprising:
- receiving the first data link message;
- storing the first data link message;
- starting a timer at an initial timer value when the first data link message is received;
- determining whether a response to the first data link message has been input;
- determining whether the timer will expire in less than a predefined amount of time;
- requesting an input from the operator before the timer expires;
- determining whether the input has been received since requesting the input;
- determining whether the timer has expired before the input is received;
- when the input is received before the timer expires, sending a second data link message; and
- when the input is not received before the timer expires, setting a status for the first data link message to expired.

2. The method of claim 1, wherein the receiving the first data link message comprises receiving the first data link message at one of an aircraft and a control center.

3. The method of claim 1, wherein the method is implemented as part of communication protocols for a Controller Pilot Data Link Communications ("Controller Pilot Data Link Communications") system.

4. The method of claim 1, wherein the first data link message comprises a Controller Pilot Data Link Communications message.

5. The method of claim 1, wherein the timer comprises a termination timer, receiver ("TTR timer") timer.

6. The method of claim 1, wherein the predefined amount of time is greater than fifteen seconds.

7. The method of claim 1, wherein the predefined amount of time is between about one fourth and about one half the duration of the initial timer value.

8. The method of claim 1, wherein requesting the input from the operator before the timer expires includes:
- displaying an expiration notice on a screen informing the operator that the timer will expire in less than a predefined amount of time;
- displaying the first data link message on the screen; and
- displaying a prompt requesting the input from the operator on the screen.

9. The method of claim 8, wherein the displaying the expiration notice on a screen includes displaying an amount of time left before timer expiration.

10. The method of claim 1, wherein requesting the input from the operator before the timer expires includes:
- audibly and autonomously announcing an expiration notice through a speaker; and
- audibly and autonomously prompting the operator for the input through the speaker.

11. The method of claim 10, wherein requesting the input from the operator before the timer expires further includes audibly and autonomously announcing the first data link message through the speaker.

12. The method of claim 1, wherein receiving the input before the timer expires includes receiving the input from the operator through an input device before the timer expires.

13. The method of claim 12, wherein the input comprises at least one of:
- a touch responsive device; and
- a sound responsive device.

14. The method of claim 1, further comprising:
- determining whether a timer is needed; and
- starting the timer only when the timer is needed.

15. A computer system, comprising:
- at least one processor;
- at least one human-machine interface device in operative communication with the processor and having at least one display device configured to display information to an operator and at least one input device configured to receive input from an operator;
- at least one communication device in operative communication with the processor and configured to send and receive data link messages; and
- at least one memory device in operative communication with the processor, the memory device comprising a computer readable medium having program instructions thereon for a method of prompting the operator to reply to a first data link message before it expires, the method including:
  - receiving the first data link message;
  - starting a timer when the first data link message is received;
  - when an input has not been received at the at least one input device at a predefined time before the timer will expire, requesting the input at the at least one input device; and
  - determining whether the input has been received via the at least one input device before the timer expires.

16. The computer system of claim 15, wherein the method further comprises:
- when the input is received via the at least one input device before the timer expires, sending a second data link message; and
- when the input is not received via the at least one input device before the timer expires, setting a status identifier for the first data link message to expired.

17. The computer system of claim 15, wherein the computer system comprises a flight management computer, a communication management unit, or an air traffic control computer.

18. A non-transitory computer readable medium comprising computer executable instructions adapted to perform a method for prompting an operator to reply to a first data link message before the first data link message expires, the method performed by a processor, the method comprising:
- receiving the first data link message;
- starting a timer when the first data link message is received;
- when the timer will expire in less than a predefined amount of time, requesting an input from the operator;
- determining whether the input is received before the timer expires;
- when the input is received before the timer expires, sending a second data link message; and when the input is not received before the timer expires, setting a status for the first data link message to expired.

19. The non-transitory computer readable medium of claim 18, wherein the program instructions stored on the computer readable medium are implemented as part of communication protocols for future air navigation controller pilot and/or flight crew data link communication (Controller Pilot Data Link Communications) systems.

20. The non-transitory computer readable medium of claim 18, wherein the program instructions stored on the computer readable medium are implemented as part of communication protocols for an aeronautical telecommunication network Controller Pilot Data Link Communications application.

* * * * *